US009077158B2

(12) United States Patent
Murayama et al.

(10) Patent No.: US 9,077,158 B2
(45) Date of Patent: Jul. 7, 2015

(54) SPARK PLUG FOR INTERNAL COMBUSTION ENGINE

(71) Applicants: DENSO CORPORATION, Kariya, Aichi-pref. (JP); ISHIFUKU Metal Industry Co., Ltd., Soka-shi, Saitama (JP)

(72) Inventors: Yuki Murayama, Toyoake (JP); Nobuo Abe, Yokkaichi (JP); Yoshinori Doi, Soka (JP); Toshiyuki Tomine, Soka (JP)

(73) Assignees: DENSO CORPORATION, Kariya (JP); ISHIFUKU METAL INDUSTRY CO., LTD., Soka-shi (JP)

( * ) Notice: Subject to any disclaimer, the term of this patent is extended or adjusted under 35 U.S.C. 154(b) by 79 days.

(21) Appl. No.: 14/040,958

(22) Filed: Sep. 30, 2013

(65) Prior Publication Data

US 2014/0091701 A1 Apr. 3, 2014

(30) Foreign Application Priority Data

Sep. 28, 2012 (JP) ..... 2012-217072

(51) Int. Cl.
*H01T 13/20* (2006.01)
*H01T 13/39* (2006.01)

(52) U.S. Cl.
CPC ..... *H01T 13/39* (2013.01)

(58) Field of Classification Search
CPC ..... H01T 13/39
USPC ..... 313/141
See application file for complete search history.

(56) References Cited

U.S. PATENT DOCUMENTS

| | | | |
|---|---|---|---|
| 4,853,582 | A | 8/1989 | Sato et al. |
| 4,926,088 | A | 5/1990 | Kler |
| 5,038,082 | A | 8/1991 | Arita et al. |
| 5,091,819 | A | 2/1992 | Christiansen et al. |
| 6,215,235 | B1 | 4/2001 | Osamura |
| 6,472,801 | B1 | 10/2002 | Matsubara et al. |

(Continued)

FOREIGN PATENT DOCUMENTS

| | | |
|---|---|---|
| CN | 102484357 | 5/2012 |
| JP | 61-26748 | 2/1986 |

(Continued)

OTHER PUBLICATIONS

Office Action (6 pages) dated Jan. 30, 2015, issued in corresponding Chinese Application No. 201310449869.X and English translation (4 pages).

*Primary Examiner* — Vip Patel
(74) *Attorney, Agent, or Firm* — Nixon & Vanderhye PC

(57) ABSTRACT

A spark plug for use in an internal combustion engine has a center electrode, an earth electrode, and an electrode chip formed on at least one of the center electrode and the earth electrode. A spark discharge gap is formed between the center electrode and the earth electrode. The electrode chip has a base section, a chromium rich layer formed on at least a part of the base section, and a diffusion layer formed between the base section and the chromium rich layer. The base section contains chromium within a range of 5 to 45 mass %, an element X within a range of 0.5 to 25 mass %, and a remainder composed of tungsten and unavoidable impurity. The chromium rich layer is larger in content of chromium than the base section. The element X contained in the base section is comprised of at least one of molybdenum, silicon, aluminum and lead.

8 Claims, 5 Drawing Sheets

(56) References Cited

U.S. PATENT DOCUMENTS

| | | | |
|---|---|---|---|
| 2001/0013746 | A1 | 8/2001 | Kanao et al. |
| 2002/0036451 | A1 | 3/2002 | Nishikawa et al. |
| 2002/0041138 | A1 | 4/2002 | Nishikawa |
| 2002/0079800 | A1 | 6/2002 | Miyashita et al. |
| 2003/0038575 | A1 | 2/2003 | Hori et al. |
| 2003/0122462 | A1 | 7/2003 | Nishikawa et al. |
| 2003/0127959 | A1 | 7/2003 | Nishikawa et al. |

FOREIGN PATENT DOCUMENTS

| | | |
|---|---|---|
| JP | H01-105485 | 4/1989 |
| JP | H01-200587 | 8/1989 |
| JP | H02-500868 | 3/1990 |
| JP | H02-100281 | 4/1990 |
| JP | H02-236981 | 9/1990 |
| JP | H02-304889 | 12/1990 |
| JP | H03-164404 | 7/1991 |
| JP | H04-125574 | 4/1992 |
| JP | H04-349385 | 12/1992 |
| JP | H05-114457 | 5/1993 |
| JP | H09-092429 | 4/1997 |
| JP | H11-012670 | 1/1999 |
| JP | H11-233233 | 8/1999 |
| JP | 2000-138089 | 5/2000 |
| JP | 2000-243535 | 9/2000 |
| JP | 2001-068249 | 3/2001 |
| JP | 2001-068252 | 3/2001 |
| JP | 2001-273966 | 10/2001 |
| JP | 2001-312122 | 11/2001 |
| JP | 2002-056949 | 2/2002 |
| JP | 2002-117955 | 4/2002 |
| JP | 2002-129268 | 5/2002 |
| JP | 2002-164146 | 6/2002 |
| JP | 2002-299005 | 10/2002 |
| JP | 2002-329872 | 11/2002 |
| JP | 2002-343533 | 11/2002 |
| JP | 2002-373802 | 12/2002 |
| JP | 2003-007421 | 1/2003 |
| JP | 2003-007424 | 1/2003 |
| JP | 2009-187954 | 8/2009 |
| JP | 2011-074488 | 4/2011 |
| JP | 2011-084808 | 4/2011 |

SPARK PLUG FOR INTERNAL COMBUSTION ENGINE

CROSS-REFERENCE TO RELATED APPLICATION

This application is related to and claims priority from Japanese Patent Application No. 2012-217072 filed on Sep. 28, 2012, the contents of which are hereby incorporated by reference.

BACKGROUND OF THE INVENTION

1. Field of the Invention

The present invention relates to spark plugs for use in internal combustion engines of motor vehicles, etc.

2. Description of the Related Art

Various types of sparks plugs are widely used to ignite a fuel mixture gas in a combustion chamber of an internal combustion engine mounted to a motor vehicle. For example, a spark plug is comprised of a center electrode and an earth electrode. A spark discharge gap is formed between the center electrode and the earth electrode. When a spark discharge is generated between the center electrode and the earth electrode of a spark plug mounted to a combustion chamber, a mixture gas of air and fuel is ignited. There is a spark plug having an improved structure in which an electrode chip is formed on at least one of the center electrode and the earth electrode in order to increase an ignition capability.

Recently, a temperature of a combustion chamber in an internal combustion engine in increased in order to improve the function of the internal combustion engine. Increasing the temperature of the combustion chamber requires superior wear resistance of the electrode chip formed on at least one of the center electrode and the earth electrode in the spark plug. There are spark abrasion or spark discharging wear and oxidation abrasion or oxidation wear which abrade the electrode chip in the spark plug. A surface of the electrode chip is instantaneously melted by the spark discharge when a spark abrasion occurs. A surface of an electrode in a spark plug is oxidized and vaporized in a high temperature environment when an oxidation abrasion occurs.

For example, iridium (Ir) is used as electrode material when an electrode chip is formed on at least one of a center electrode and an earth electrode of a spark plug because iridium has a high melting point and a superior spark discharging wear resistance. However, because iridium is a noble metal available on the commercial market at a high cost using iridium increases a manufacturing cost of the spark plug. In order to reduce the manufacturing cost, tungsten (W) is used instead of iridium because of having a higher melting point, when compared with iridium, and a superior spark wear resistance, and is available on the commercial market at low cost. However, because tungsten has a large chemical affinity with oxygen, tungsten has inadequate oxidation resistance. In order to avoid this problem, a patent document, a Japanese patent laid open publication No. H02-100281 has disclosed to use electrode material containing chromium (Cr) having a superior oxidation resistance in addition to tungsten.

However, the spark plug disclosed in Japanese patent laid open publication No. H02-100281 has the following problem.

In order to have an adequate oxidation resistance of the electrode chip, the electrode material contains chromium having a melting point of approximately 1857° C. which is lower than a melting point of approximately 3407° C. (or 3380° C.) of tungsten. Because increasing a content of chromium in the electrode chip decreases the melting point of the electrode chip, the electrode chip cannot provide an adequate spark discharging wear resistance. On the other hand, decreasing a content of chromium in the electrode chip can suppress decreasing of a melting point and a spark discharging wear resistance of the electrode chip. However, there is a possibility of it being difficult for the electrode chip to adequately maintain a necessary oxidation resistance.

There is accordingly a strong demand to provide a spark plug having an adequate spark discharging wear resistance and oxidation resistance with low manufacturing cost.

SUMMARY

It is therefore desired to provide a spark plug, for use in internal combustion engines, having a superior spark discharging wear resistance, a superior oxidation resistance and a long life, and manufactured with low manufacturing cost.

An exemplary embodiment provides a spark plug for use in an internal combustion engine. The spark plug has an improved structure comprised of a center electrode, an earth electrode and one or more electrode chips. The earth electrode is arranged to face the center electrode in order to form a spark discharge gap between the center electrode and the earth electrode. The electrode chip is formed on at least one of the center electrode and the earth electrode. For example, when the electrode chips are formed on both the center electrode and the earth electrode, the spark discharge gap is formed between the electrode chip formed on the center electrode and the electrode chip formed on the earth electrode. In particular, the electrode chip is comprised of a base section, a chromium rich layer, and a diffusion layer. The chromium rich layer is formed on at least a part of the base section. In other words, at least a part of the base section is covered with the chromium rich layer. The diffusion layer is formed between the base section and the chromium rich layer. In particular, the base section in the electrode chip is comprised of chromium within a range of 5 to 45 mass %, an element X within a range of 0.5 to 25 mass %, and a remainder composed of tungsten and unavoidable impurity. The chromium rich layer is larger in content of chromium than the base section. The element X contained in the base section is comprised of at least one of molybdenum (Mo), silicon (Si), aluminum (Al) and palladium (Pd).

As previously described, the electrode chip is formed on at least one of the center electrode and the earth electrode in the spark plug according to the present invention. The electrode chip is comprised of the base section, the chromium rich layer and the diffusion layer. In particular, at least a part of the base section is covered with the chromium rich layer. It is also acceptable that the entire surface of the base section is covered with the chromium rich layer in the electrode chip. In the electrode chip, the chromium rich layer is larger in content of chromium (Cr) than the base section. Further, the diffusion layer is formed between the base section and the chromium rich layer. This structure of the spark plug makes it possible to have both an improved spark discharging wear resistance and an improved oxidation resistance simultaneously.

That is, the inventors of the present invention have noticed that it is necessary and effective for the surface of the electrode chip to have the oxidation resistance, and to increase the content of chromium in order to maintain a chromium oxidation protection film on the electrode chip, rather than to increase a content of chromium on the electrode chip in order to generate the chromium oxidation protection film.

In the spark plug according to the present invention, the chromium rich layer is formed on the surface of the electrode chip, where the content of chromium in the chromium rich layer is larger than the content of chromium in the base section. This structure makes it possible to generate a hard chromium oxidation protection film on the surface of the chromium rich layer in the electrode chip when the spark plug is initially used. After the generation of the chromium oxidation protection film on the surface of the chromium rich layer, it is possible to maintain the chromium oxidation protection film by diffusing of chromium contained in the base section. This makes it possible to provide the spark plug having a long life.

On the other hand, the base section has the content of chromium within a specific range. That is, the base section has the content of chromium which is lower than the content of chromium in the chromium rich layer. That is, because the presence of the chromium rich layer formed on the surface of the electrode chip makes it possible to adequately maintain the oxidation resistance, it is possible to decrease the content of chromium in the base section. This suppresses increasing the content of chromium in the base section. That is, this structure makes it possible to suppress decreasing of the melting point and spark discharging wear resistance of the electrode chip which is caused by the presence of chromium. In other words, this structure of the base section provides the characteristics of tungsten (W) which has a high melting point and spark discharging wear resistance. Accordingly, the electrode chip in the spark plug can adequately have the highly spark discharging wear resistance. As a result, it is possible for the spark plug according to the present invention to have both the spark discharging wear resistance and the oxidation resistance, simultaneously and therefore to have a long life.

In the electrode chip in the spark plug according to the present invention, the diffusion layer is further formed between the chromium rich layer and the base section. Because the diffusion layer contains the elements which form the chromium rich layer and the base section, the chromium rich layer and the base section are formed together with the diffusion layer in the electrode chip. This structure makes it possible to strongly bond the chromium rich layer to the base section through the diffusion layer. This structure can suppress the chromium rich layer formed on the surface of the electrode chip from being separated and lost, and makes it possible to maintain the superior oxidation resistance of the electrode chip for a long period of time.

Further, the base section contains the element X which has a content within a specific range, i.e. within the range of 0.5 to 25 mass %. The element X is at least one of elements such as molybdenum (Mo), silicon (Si) aluminum (Al) and palladium (Pd). This structure makes it possible to improve the sinterability of the base section, i.e. increase the sintered density of the base section by firing or sintering. Accordingly, it is possible to increase the durability of the base section in the electrode chip of the spark plug, and to increase the spark discharging wear resistance and the oxidation resistance of the electrode chip. That is, if the base section in an electrode chip has a low sintered density, a plurality of porous is generated in the base section and oxidation is thereby progressed in the base section. Furthermore, there is a possibility that the base section may be broken by the presence of porosity when the spark plug is vibrated, for example when an internal combustion engine works, to which the spark plug is mounted. There is a possibility of decreasing the durability of the spark plug. It is preferable to increase the sintered density of the base section in the electrode chip in order to decrease the presence of porosity in the base section. This structure of the electrode chip in the spark plug makes it possible to provide important effects such as an improved spark discharging wear resistance and an improved oxidation resistance.

Still further, the base section contains inexpensive tungsten, Because tungsten (W) is available on the commercial market at low cost, it is possible to decrease the manufacturing cost of the spark plug. The present invention can provide the electrode chip with low manufacturing cost, and is therefore possible to drastically decrease the manufacturing cost of the spark plug when compared with that of a conventional spark plug having an electrode chip which contains noble metal such as iridium (Ir) which is available on the commercial market at high cost.

As previously described, it is possible for the present invention to provide the spark plug having a superior spark discharging wear resistance, a superior oxidation resistance and a long life with low cost.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
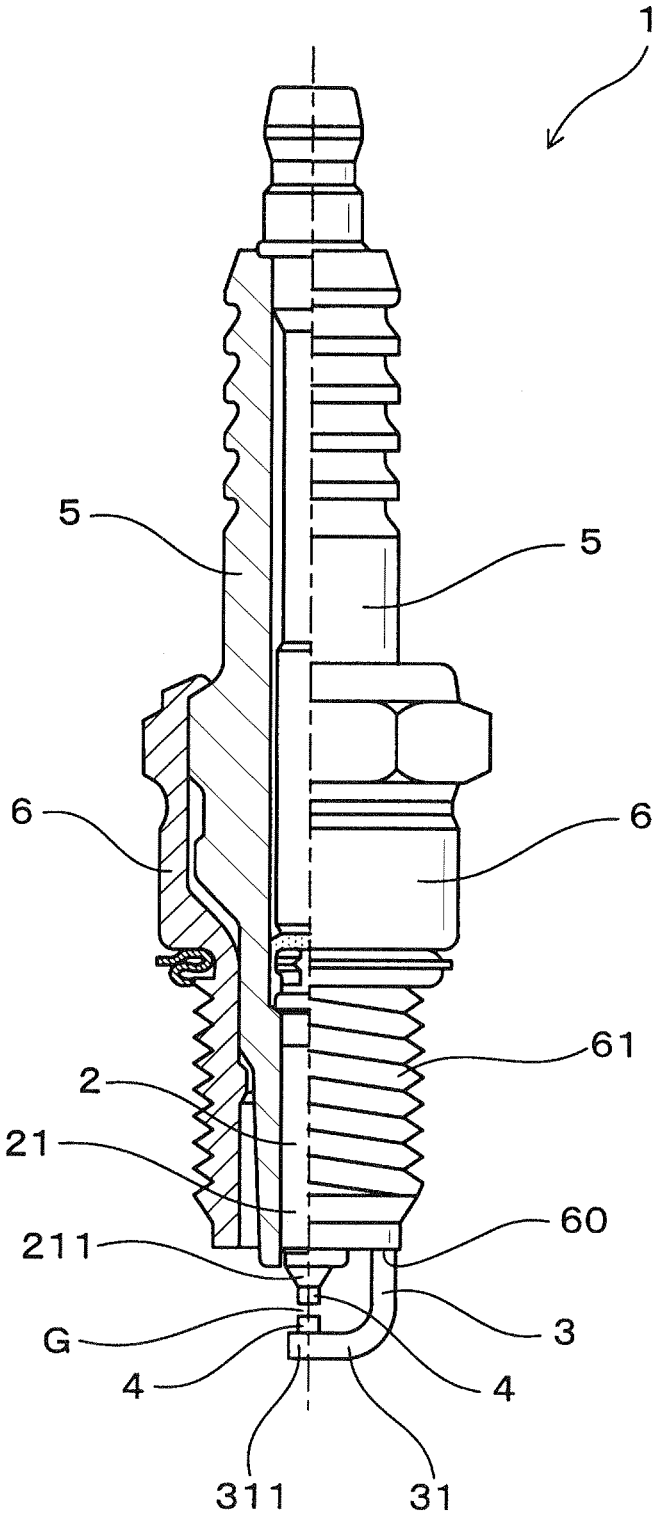
FIG. 1 is a view showing a cross section of a part of a spark plug according to a first exemplary embodiment of the present invention.

Hereinafter, various embodiments of the present invention will be described with reference to the accompanying drawings. In the following description of the various embodiments, like reference characters or numerals designate like or equivalent component parts throughout the several diagrams.

The spark plug according to the present invention is comprised of the center electrode, the earth electrode, the electrode chip formed on at least one of the center electrode and the earth electrode. The base section contains chromium (Cr) within a range of 5 to 45 mass % in a total content of the base section.

When the content of chromium in the base section is less than 5 mass %, there is a possibility of it being difficult for the electrode chip to have an adequate oxidation resistance.

On the other hand, when the content of chromium in the base section is more than 45 mass %, a melting point of the electrode chip decreases, and as a result there is a possibility of it being difficult for the electrode chip to have an adequate spark discharging wear resistance.

It is therefore preferable for the base section of the electrode chip in the spark plug to contain chromium within a range of 5 to 45 mass % in a total content of the base section.

Further, it is more preferable for the base section of the electrode chip in the spark plug to contain chromium within a range of 15 to 30 mass % in a total content of the base section.

A content of an element X in the base section in the electrode chip formed on at least one of the center electrode and the earth electrode in the spark plug is within a range of 0.5 to 25 mass % in a total content of the base section When the content of the element X in the base section is less than 0.5 mass %, there is a possibility of it being difficult for the electrode chip to adequately improve the sinterability, i.e. a sintered density of the base section.

On the other hand, when the content of the element X in the base section is more than 25 mass %, a melting point of the base section in the electrode chip decreases and as a result there is a possibility of it being difficult for the electrode chip to have an adequate spark discharging wear resistance. Further, there is a possibility of it being difficult to decrease an effect of improving the sinterability of the base section provided by adding the element X in the base section.

In the spark plug according to the present invention, at least a part of the base section is covered with the chromium rich layer is formed on at least a part of the surface of the electrode chip. That is, it is possible to form at least a part of the surface of the electrode chip which is exposed to the outside of the spark plug. A diffusion layer is formed between the base section and the chromium layer in the electrode chip. It is possible to form the diffusion layer at least a part between the chromium rich layer and the base section in the electrode chip.

A spark discharging wear occurs on a spark discharging surface of the electrode chip in a spark plug, which faces the surface of another electrode chip and on which a spark discharge is generated in order to ignite a fuel mixture gas in a combustion chamber. On the other hand, oxidation wear occurs on the other surface of the electrode chip other than the spark discharging surface of the electrode chip. Accordingly, it is preferable to form the chromium rich layer (and the diffusion layer) on the surface of the electrode chip other than the spark discharging surface in order to prevent oxidation wear and to have the superior oxidation resistance.

The diffusion layer is formed between the base section and the chromium rich layer. The diffusion layer is comprised of the elements forming the base section and the elements forming the chromium rich layer. For example, a part of the diffusion layer, which is close to the base section, si rich in the elements forming the base section, and a part of the diffusion layer, which closes to the chromium rich layer, is a rich in the elements forming the chromium rich layer.

It is acceptable for the chromium rich layer to contain the same elements contained in the base section in the spark plug according to the present invention.

This structure makes it possible to strongly bond the base section and the chromium rich layer through the diffusion layer, and to suppress the chromium rich layer from being separated from the surface of the electrode chip. The elements contained in the base section indicate elements other than unavoidable impurity contained in the base section.

It is preferable for the chromium rich layer to contain chromium which is larger in content than chromium contained in the base section by not less than 5 mass %. This structure makes it possible to adequately grow and maintain a more strongly chromium rich layer on the surface of the electrode chip (or the chromium rich layer). This makes it possible for the electrode chip to provide and maintain the oxidation resistance.

When a difference in content of chromium between the base section and the chromium rich layer is within a range of less than 5 mass %, there is a possibility of it being difficult to adequately grow and maintain a more strongly chromium rich layer on the surface of the electrode chip (or the chromium rich layer) at the beginning of initial use of the spark plug.

Accordingly, it is more preferable for the chromium rich layer to contain chromium which is larger in content than chromium contained in the base section by not less than 5 mass %.

Further, it is preferable for the chromium rich layer to have a thickness within a range of 1 to 30 μm. This structure makes it possible to grow a more strongly chromium rich layer on the surface of the electrode chip (or the chromium rich layer) at the initial use of the spark plug. Further, this structure makes it possible for the electrode chip to adequately have the oxidation resistance.

When the chromium rich layer has a thickness of less than 1 μm, there is a possibility of it being difficult for the electrode chip to adequately have the oxidation resistance.

On the other hand, when the chromium rich layer has a thickness of more than 30 μm, the melting point of the electrode chip decreases due to the presence of chromium, and there is a possibility of it being difficult for the electrode chip to adequately have the oxidation resistance. Accordingly, it is more preferable for the chromium rich layer to have a thickness within a range of 1 to 30 μm.

It is acceptable for the electrode chip to have the chromium rich layer processed by a diffusion metallizing process. Using such a diffusion metallizing process makes it possible to easily and precisely form the diffusion layer between the base section and the chromium rich layer, and further to bond the chromium rich layer to the base section more strongly. As a result, this makes it possible to more suppress the chromium rich layer from being separated and lodst from the surface of the electrode chip.

It is also possible to grow the chromium rich layer by a method other than the diffusion metallizing process. For example, it is possible to use an electroplating process, a sputtering process, a deposition process, etc. in order to form a chromium film on the surface of the base section. After the formation of the chromium film, it is possible to form the chromium rich layer and the diffusion layer by a diffusion annealing process under the condition of vacuum or inert atmosphere at a temperature within a range of 500° C. to 1500° C.

First Exemplary Embodiment

A description will be given of a spark plug 1 according to a first exemplary embodiment with reference to FIG. 1 to FIG. 4.

Figure 2:
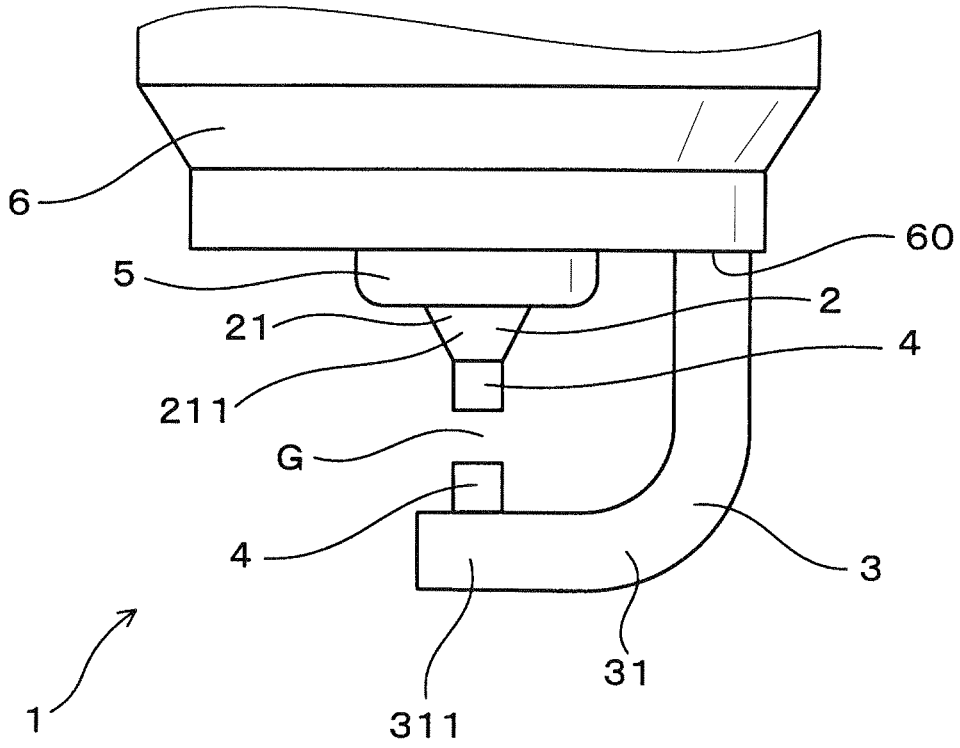
FIG. 2 is a view showing a structure of a center electrode, an earth electrode, an electrode chip formed on the center electrode, an electrode chip formed on the earth electrode and a spark discharge gap (G) in the spark plug according to the first exemplary embodiment of the present invention shown in FIG. 1.

FIG. 1 is a view showing a cross section of a part of the spark plug 1 according to the first exemplary embodiment. FIG. 2 is a view showing a structure of a center electrode 2, an earth electrode 3, an electrode chip 4 formed on the center electrode 2, an electrode chip 4 formed on the earth electrode and a spark discharge gap G in the spark plug 1 according to the first exemplary embodiment shown in FIG. 1.

As shown in FIG. 1 and FIG. 2, the spark plug 1 is comprised of the center electrode 2, the earth electrode 3, the electrode chip 4 formed on the center electrode 2 and the electrode chip 4 formed on the earth electrode 3. The spark discharge gap G is formed between the center electrode 2 and the earth electrode 3. In more detail, the spark discharge gap G is formed between the electrode chip 4 formed on the center electrode 2 and the electrode chip 4 formed on the earth electrode 3.

Figure 3:
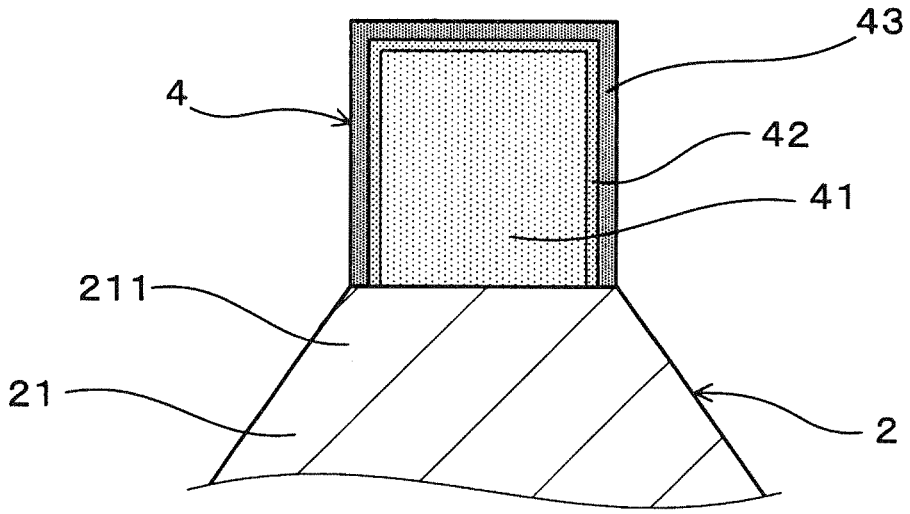
FIG. 3 is a view showing a cross section of the electrode chip formed on the center electrode in the spark plug according to the first exemplary embodiment of the present invention.

FIG. 3 is a view showing a cross section of the electrode chip 4 formed on the center electrode 2 in the spark plug 1 according to the first exemplary embodiment. As shown in FIG. 3, the electrode chip 4 is comprised of the base section 41, the chromium rich layer 43 and the diffusion layer 42. The chromium rich layer 43 is formed on at least a part of the base section 41 so that the base section 41 is covered with the chromium rich layer 43. The chromium rich layer 43 is larger in content of chromium (Cr) than the base section 41. The diffusion layer 42 is formed between the base section 41 and the chromium rich layer 43.

In particular, the electrode chip 4 contains chromium within a range of 5 to 45 mass %, an element X within a range of 0.5 to 25 mass %, and a remainder composed of tungsten and unavoidable impurity. The element X contained in the base section 41 is comprised of at least one of molybdenum (Mo), silicon (Si), aluminum (Al) and palladium (Pd).

A description will now be given of the electrode chips 4 formed on the center electrode 2 and the earth electrode 3 in detail.

As shown in FIG. 1, the spark plug 1 according to the first exemplary embodiment is comprised of the center electrode 2, the earth electrode 3, the electrode chips 4, an electric insulator 5 such as a ceramic electric insulator, etc., and a housing case 6. The housing case 6 has a cylindrical shape. A screw section 61 is formed at the outer periphery of the housing case 6. The spark plug 1 is fixed to a wall section of a combustion chamber (not shown) of an internal combustion engine (not shown) through a screw hole (not shown) formed in the wall section of the combustion chamber and the screw section 61 of the housing case 6.

The electric insulator 5 has a cylindrical shape. The electric insulator 5 is supported in the inside of the housing case 6. The center electrode 2 is supported in the inside of the electric insulator 5 so that the center electrode 2 is projected from the electric insulator 5 and exposed to the outside, i.e. exposed to a fuel mixture in the combustion chamber when the spark plug 1 is mounted to an internal combustion engine.

The earth electrode 3 is connected to a front end surface 60 of the housing case 6. As shown in FIG. 1 and FIG. 2, the earth electrode 3 extends from the front end surface 60 of the housing case 6 toward the center electrode 2, and is curved so that the earth electrode 3 is faced to the center electrode 2 along an axial direction of the spark plug 1.

As shown in FIG. 2, the electrode chip 4 is connected to a front end section 21 of a center electrode base section 21 of the center electrode 2 by welding. In addition, the electrode chip 4 is connected to an opposition section 311 of an earth electrode base section 31 of the earth electrode 3 by welding. Each of the center electrode base section 21 of the center electrode 2 and the earth electrode base section 31 of the earth electrode 3 is made of nickel (Ni) alloy. Each of the electrode chips has a cylindrical shape. The spark discharge gap G is formed between the electrode chips 4.

As shown in FIG. 3, the electrode chip 4 is comprised of the base section 41, the chromium rich layer 43, and the diffusion layer 42 formed between the base section 41 and the chromium rich layer 43. The electrode chip 4 formed on the earth electrode 3 has the same structure as the electrode chip 4 formed on the center electrode 2.

In particular, the base section 41 is comprised of chromium (Cr) within a range of 5 to 45 mass %, an element X within a range of 0.5 to 25 mass %, and a remainder composed of tungsten and unavoidable impurity. The element X contained in the base section 41 is comprised of at least one of molybdenum (Mo), silicon (Si), aluminum (Al) and palladium (Pd).

The chromium rich layer 43 is formed on the entire surface of the electrode chip 4 so that the chromium rich layer 43 is exposed to the outside of the spark plug 1, as shown in FIG. 3. The chromium rich layer 43 contains the same elements (Cr, the element X, and W) contained in the base section 41. In particular, the chromium rich layer 43 is larger in content of chromium than the base section 41. Specifically, the content of chromium in the chromium rich layer 43 is larger than that of the base section 41 by not less than 5 mass %. Further, the chromium rich layer 43 has a thickness within a range of 1 to 30 μm. Still further, the chromium rich layer 43 is formed by a diffusion metallizing process.

The diffusion layer 42 is comprised of the elements which form the base section 41 and the elements which form the chromium rich layer 43. Specifically, the content of the elements, which form the base section 41, is gradually increased in the diffusion layer 42 when the diffusion layer 42 is more close to the base section 41 side. On the other hand, the content of the elements in the chromium rich layer 43, is gradually increased to the content of the elements in the diffusion layer 42 when a part in the diffusion layer 42 is gradually close to the chromium rich layer 43 side.

Further, as will be explained later, the diffusion layer 42 is formed when the chromium rich layer 43 is formed by diffusion metallizing process.

Next, a description will now be given of a method of producing the electrode chip 4 in the spark plug 1 according to the first exemplary embodiment.

Raw material powder is prepared in order to have a chemical composition of the electrode chip 4. The raw material powder is molded to a mold body having a predetermined shape of the electrode chip 4. A heating process is performed for the mold body placed in the heat resistant vessel in order to fire/sinter the mold body at a temperature within a range of 1300 to 1500° C. under non-oxidation atmosphere (for example, argon (Ar) atmosphere). This process makes it possible to generate the base section 41 having a column shape having a diameter of 0.55 mm and an axial length of 0.8 mm.

Next, the base section 41 previously produced is treated by a diffusion metallizing process. Specifically, the base section 41 is placed in a heat resistant vessel, and chromium (Cr) is placed around the base section 41 in the heat resistant vessel. The heat resistant vessel is sealed and fired at a temperature of 1500° C. under argon (Ar) atmosphere over one hour. This produces the chromium rich layer 43 on the surface of the base section 41, and the diffusion layer 42 is also formed between the base section 41 and the chromium rich layer 43. The production of the electrode chip 4 comprised of the base section 41, the diffusion layer 42 and the chromium rich layer 43 is completed, as shown in FIG. 3.

Next, a description will now be given of the action and effects of the spark plug 1 according to the first exemplary embodiment.

As shown in FIG. 2, in the structure of the spark plug 1 according to the first exemplary embodiment, the electrode chip 4 is formed on each of the center electrode 2 and the earth electrode 3. As previously explained, the electrode chip 4 is comprised of the base section 41, the chromium rich layer 43 and the diffusion layer 42. The base section 41 is covered with the chromium rich layer 43. The chromium rich layer 43 is larger in content of chromium than the base section 41. The diffusion layer 42 is formed between the base section 41 and the chromium rich layer 43. This structure of the spark plug 1 according to the first exemplary embodiment makes it possible to have both spark discharging wear resistance and oxidation resistance.

That is, the inventors of the present invention have noticed that it is necessary and effective for the surface of the electrode chip 4 to have the oxidation resistance, and it is further necessary to increase the content of chromium in order to maintain a chromium oxidation protection film in the electrode chip 4, rather than to increase a content of chromium in order to generate the chromium oxidation protection film. Accordingly, in the spark plug 1 according to the first exemplary embodiment, the chromium rich layer is formed on the surface of the electrode chip 4, where the content of chromium in the chromium rich layer 43 is larger than the content of chromium in the base section 41. This structure makes it possible to generate a chromium oxidation protection film, which is hard, on the surface of the chromium rich layer in the electrode chip 4 at the initial use of the spark plug 1. After the generation of the chromium oxidation protection film on the surface of the chromium rich layer 43, it is possible to maintain the chromium oxidation protection film by chromium contained in the base section 41.

On the other hand, the base section 41 has the content of chromium within a specific range. That is, the base section 41 has the content of chromium which is lower than the content of chromium in the chromium rich layer 43. Because the presence of the chromium rich layer 43 formed on the surface of the electrode chip 4 can adequately maintain the oxidation resistance, it is possible to decrease the content of chromium in the base section 41. This suppresses increasing the content of chromium in the base section 41. That is, this structure makes it possible to suppress decreasing of the melting point and spark discharging wear resistance of the electrode chip which is caused by the presence of chromium. In other words, this structure of the base section 41 makes it possible to provide the characteristics of tungsten (W) having a high melting point and spark discharging wear resistance. Accordingly, the electrode chip 4 in the spark plug 1 according to the first exemplary embodiment can adequately have the highly spark discharging wear resistance. As previously described, it is possible for the spark plug 1 according to the first exemplary embodiment to have the spark discharging wear resistance and the oxidation resistance, simultaneously and therefore to have a long life.

In the electrode chip 4 in the spark plug 1 according to the first exemplary embodiment, the diffusion layer 42 is further formed between the chromium rich layer 43 and the base section 41. Because the diffusion layer 42 is comprised of the elements which form the chromium rich layer 43 and the base section 41, the chromium rich layer 43 and the base section 41 are formed together through the diffusion layer 42. This structure makes it possible to strongly bond the chromium rich layer 43 with the base section 41 through the diffusion layer 42. This makes it possible to suppress the chromium rich layer 43 formed on the surface of the electrode chip 4 from being separated and lost from the surface of the electrode chip 4, and possible to maintain the superior oxidation resistance of the electrode chip 4 for a long period of time.

Still further, the base section 41 contains the element X having a content within a specific range (i.e. within the range of 0.5 to 25 mass %). The element X is at least one of elements such as molybdenum (Mo), silicon (Si) aluminum (Al) and palladium (Pd). This structure makes it possible to improve the sinterability of the base section 41, i.e. increase the sintered density of the base section 41 by sintering. Accordingly, it is possible to increase the durability of the base section 41 in the electrode chip 4 of the spark plug 1, and to increase the spark discharging wear resistance and the oxidation resistance of the electrode chip.

Further, the base section 41 contains tungsten (W) which is available on the commercial market at high cost. This makes it possible to decrease the manufacturing cost of the spark plug 1 according to the first exemplary embodiment. The first exemplary embodiment can provide the electrode chip 4 with low manufacturing cost, and it is therefore possible to drastically decrease the manufacturing cost of the spark plug 1 when compared with that of a conventional spark plug having an electrode chip which contains noble metal such as iridium (Ir) which is available on the commercial market at high cost.

It is acceptable for the chromium rich layer 43 to contain the same elements contained in the base section 41 in the spark plug 1 according to the first exemplary embodiment. This structure makes it possible to strongly bond the base section 41 and the chromium rich layer 43 through the diffusion layer 42, and to more suppress the chromium rich layer 43 from being separated from the electrode chip 4 and lost from the surface of the electrode chip 4.

It is preferable for the chromium rich layer 43 to have a content of chromium which is larger than that of the base section 41 by not less than 5 mass %. This structure makes it possible to adequately grow the chromium rich layer 43 more strongly and to maintain the chromium rich layer 43 on the surface of the electrode chip 4 (or the chromium rich layer 42). This structure makes it possible to provide the electrode chip 4 having a superior oxidation resistance which is maintained for a long period of time.

Further, it is preferable for the chromium rich layer 43 to have a thickness within a range of 1 to 30 μm. This structure makes it possible to grow the chromium rich layer 43 more strongly on the surface of the electrode chip 4 (or the chromium rich layer 42) when the spark plug 1 is initially used. Further, this structure makes it possible for the electrode chip 4 to adequately have the oxidation resistance.

It is acceptable for the electrode chip 4 to have the chromium rich layer 43 processed by a diffusion metallizing process. Using such a diffusion metallizing process makes it possible to easily and precisely form the diffusion layer 42 between the base section 41 and the chromium rich layer 43, and further to bond the chromium rich layer 43 to the base section 41 more strongly. As a result, this makes it possible to more suppress the chromium rich layer 43 from being separated and lost from the surface of the electrode chip 4.

As previously described in detail, the first exemplary embodiment provides the spark plug 1 having a superior spark discharging wear resistance, the oxidation resistance and a long life.

As shown in FIG. 3, in the structure of the spark plug 1 according to the first exemplary embodiment, the chromium rich layer 43 (and the diffusion layer 42) is formed on the entire surface of the electrode chip 4. The concept of the present invention is not limited by this structure.

Figure 4:
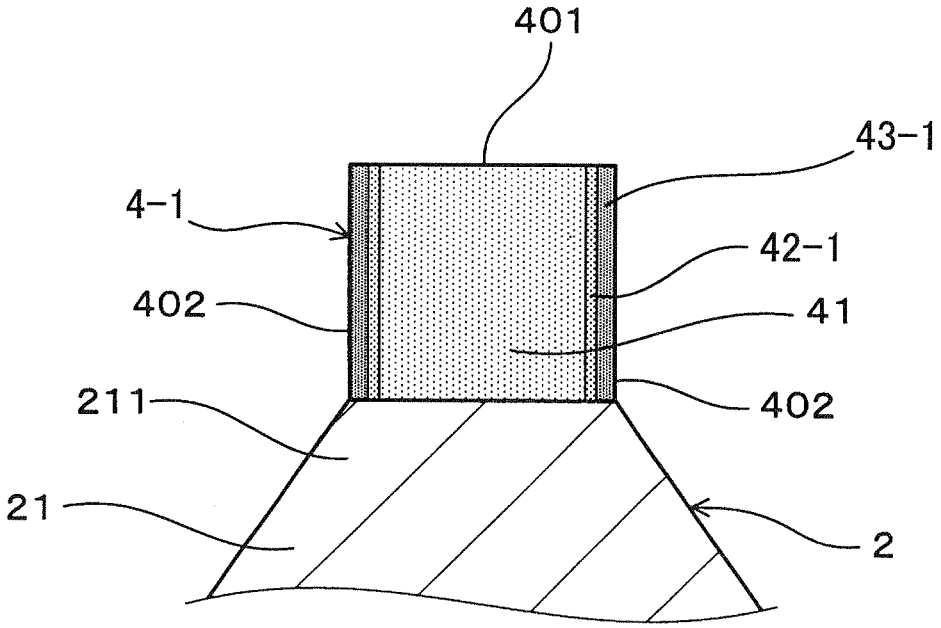
FIG. 4 is a view showing a cross section of a modification of the electrode chip formed on the center electrode in the spark plug according to the first exemplary embodiment of the present invention.

FIG. 4 is a view showing a cross section of a modification 4-1 of the electrode chip 4 formed on the center electrode 2 in the spark plug 1 according to the first exemplary embodiment.

As shown in FIG. 4, the modification of the electrode chip 4-1 has a structure in which a chromium rich layer 43-1 and a diffusion layer 42-1 are formed on the side of the base section 41. That is, the chromium rich layer 43-1 is not formed on the top surface of the base section 41 which faces a spark discharge surface 401 side, i.e., which faces the earth electrode 3 because the top part of the electrode chip 4, which faces the spark discharge surface 401 side, is strongly affected and lost volume by the spark discharging. It is therefore possible to form the chromium rich layer 43-1 (and the diffusion layer 42-1) on the side surface of the base section 41 only, which is worn out by oxidation during the spark discharging.

Second Exemplary Embodiment

A description will be given of the second exemplary embodiment with reference to FIG. 5.

The second embodiment prepared various test samples having a different content of chromium (Cr) contained in the base section and evaluated a wear resistance of the electrode chip, i.e. the base section in each of the test samples.

That is, the second exemplary embodiment, and the third to fifth exemplary embodiment (which will be explained later) were evaluated for wear resistance of using each of the test samples, in particular, evaluated for the spark discharging wear resistance and oxidation resistance of each of the test samples.

The second exemplary embodiment prepared a plurality of test samples. The base section of the electrode chip as each of the test sample has a different content (x1 mass %) of chromium (Cr). In order to correctly evaluate the wear resistance of the base section in each of the test samples, the electrode chip as each of the test samples was comprised of the base section only, did not contain the chromium rich layer and the diffusion layer.

The base section had a chemical composition of tungsten (W) of (90−x1) mass %, chromium (Cr) of x 1 mass %, and palladium (Pd) of 10 mass %. That is, the base section of each of the test samples can be expressed by the following equation:

$$(90-x1)W\text{-}x1Cr\text{-}10Pd.$$

The second exemplary embodiment performed a durability test for spark plugs equipped with the electrode chips as the test samples in order to evaluate the wear resistance of each of the electrode chips as the test samples.

In the durability test for the spark plugs having the test samples, the electrode chip as the test sample was bonded to each of the center electrode and the earth electrode in each of the spark plugs by laser welding, and each of the spark plug was mounted to a straight six engine having an engine displacement of 2500 cc. The engine was operated at 5600 rpm (i.e. full load) over 100 hours.

In the evaluation of the wear resistance of each of the test samples, the electrode chip (as test sample) was photographed before and after the durability test, and a three dimension (3D) model of each of the electrode chips before and after the durability test was made by using a computer aided design (CAD) software such as Uni-Graphics (UG), etc. A lost volume of each of the test samples as a difference in volume before and after the durability test was calculated by comparing the obtained 3D models.

Figure 5:
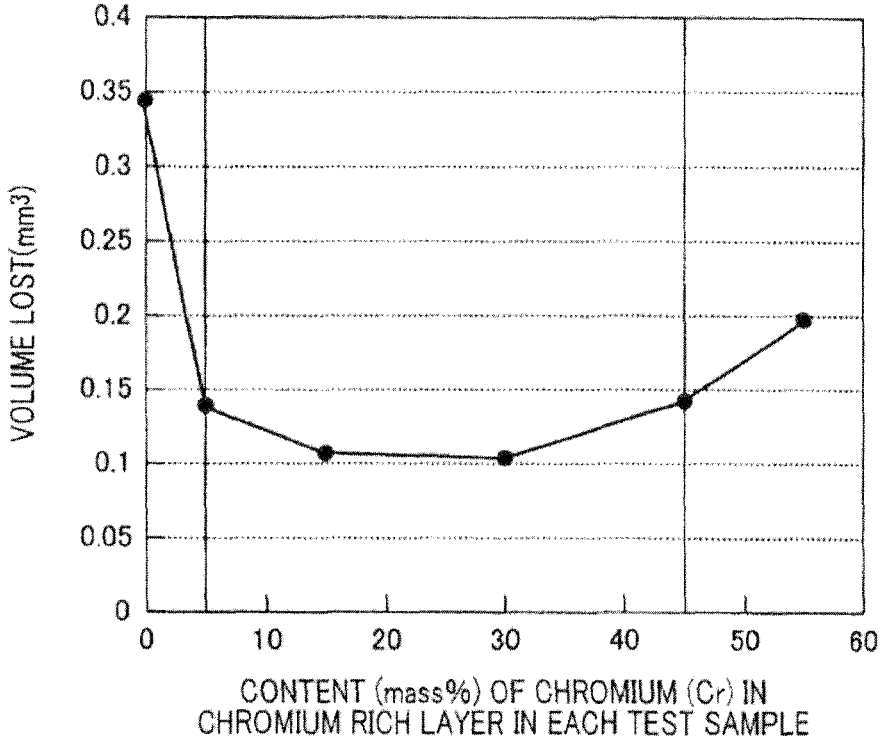
FIG. 5 is a view showing a graph of a relationship between a content (mass %) of chromium in a base section of each of electrode chips as test samples and a lost volume of the electrode chip after a durability test according to a second exemplary embodiment of the present invention.

FIG. 5 is a view showing a graph of a relationship between the content (mass %) of chromium (Cr) in the base section in each of the electrode chips (test samples) and a volume ($mm^3$) of the electrode chip after the durability test according to the second exemplary embodiment.

As can be clearly understood from the test results shown in FIG. 5, the test samples having a content of chromium within a range of 5 to 45 mass % have a lost volume of not more than 0.15 $mm^3$, and these test samples therefore had a superior wear resistance. In particular, when the test samples having a content of chromium within a range of 15 to 30 mass % had a more decreased lost volume and therefore had a more superior wear resistance.

On the other hand, the test sample having a content of chromium within a range of less than 5 mass % and more than 45 mass % had an increased lost volume.

As previously described in detail, it is possible for the base section in the electrode chip to have a superior wear resistance such as the superior spark discharging wear resistance and the superior oxidation resistance when the base section has a content of chromium within a range of 5 to 45 mass %.

It is more preferable for the base section in the electrode chip to have a content of chromium within a range of 15 to 30 mass % in order to more enhance the wear resistance.

Third Exemplary Embodiment

A description will be given of the third exemplary embodiment with reference to FIG. 6. The third exemplary embodiment prepared test samples as electrode chips having a different content of palladium (Pd) as the element X and evaluated a sinterability of each of the test samples.

The third exemplary embodiment prepared a plurality of test samples, i.e. electrode chips comprised of a base section having a different content (x2 mass %) of palladium (Pd). That is, the base section of each of the test samples can be expressed by the following equation:

$$60W\text{-}(40-x2)Cr\text{-}x2Pd.$$

The third exemplary embodiment detected a sintered density of each of the base sections (as the test samples) in order to evaluate the sinterability of each of the test samples. A sintered density of each of the test samples was detected by the Archimedes method by comparing a detected sintered density with an ideal density.

Figure 6:
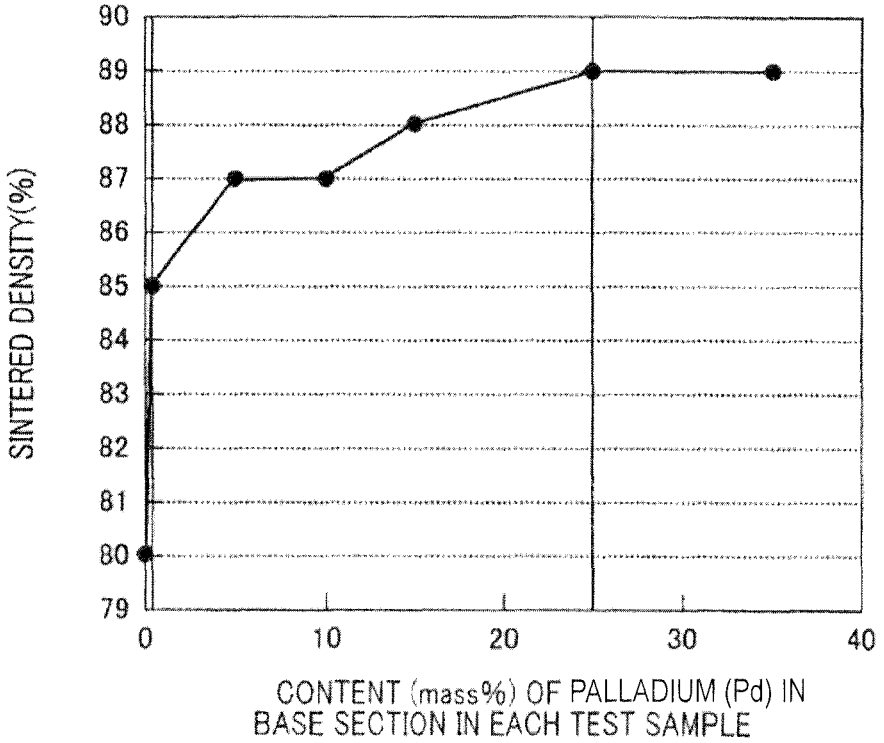
FIG. 6 is a view showing a graph of a relationship between a content (mass %) of palladium in a base section of an electrode chip as test sample and a sintered density of the electrode chip according to a third exemplary embodiment of the present invention.

FIG. 6 is a view showing a graph of a relationship between a content of palladium (Pd) in the base section of each of the electrode chips (as the test samples) and a sintered density (as a sinterability) of each of the electrode chips according to the third exemplary embodiment.

As can be clearly understood from the results shown in FIG. 6, the base sections as the test samples having a content of palladium (Pd) of not less than 0.5 mass % had a sintered density of not less than 85%.

On the other hand, when the content of palladium (Pd) in the base section becomes more than 85%, a sintered density of the test sample approximately did not increase.

As a result, it can be understand to increase the sinterability (or the sintered density) of the base section in the electrode chip when a content of palladium (Pd) in the base section is within a range of 0.5 to 25 mass %.

As previously described, the third exemplary embodiment used palladium (Pd) as the element X contained in the base section of the electrode chip. However, the concept of the present invention is not limited by this structure. For example, it is possible to use one of molybdenum (Mo), silicon (Si), or aluminum (Al) instead of palladium (Pd).

Table 1 shows test results of the sinterability (as a sintered density) of test samples 1 to 5 having a different composition of the element X such as palladium (Pd), molybdenum (Mo), silicon (Si), and aluminum (Al) in the base section.

Further, Table 1 shows the result of wear resistance (lost volume) in addition to the result of the sinterability of each of the test samples. As shown in Table 1, the results of the sinterability and the wear resistance of the test samples 1 according to the third exemplary embodiments have the same results of the test samples of the second exemplary embodiment previously described.

TABLE 1

| Test sample No. | Composition (mass %) of base section | Sintered density (%) | Lost volume ($mm^3$) |
|---|---|---|---|
| 1 | 70W—30Cr | 80 | 0.243 |
| 2 | 60W—30Cr—10Pd | 87 | 0.104 |
| 3 | 60W—30Cr—10Mo | 85 | 0.135 |
| 4 | 60W—30Cr—10Si | 86 | 0.121 |
| 5 | 60W—30Cr—10Al | 86 | 0.113 |

As can be clearly understood from Table 1, the test samples No. 3, No. 4 and No. 5 containing the element X which is selected from one of molybdenum (Mo), silicon (Si), and aluminum (Al) have a sintered density which is higher than the sintered density of the test sample No. 1 without containing any element X. Furthermore, the test samples No. 3, No. 4 and No. 5 have approximately the same sintered density of the test sample No. 2 containing palladium (Pd). Accordingly, the test samples No. 2, No. 3, No. 4 and No. 5 have the superior sinterability.

Still further, it can be clearly understood from the test results shown in Table 1 that the test samples No. 3, No. 4 and No. 5 were extremely smaller in lost volume than the test sample No. 1, and the test samples No. 3, No. 4 and No. 5 had approximately the same lost volume of the test sample No. 2. Accordingly, the test samples No. 3, No. 4 and No. 5 had a superior wear resistance.

Fourth Exemplary Embodiment

A description will be given of the fourth exemplary embodiment with reference to FIG. 7. The fourth exemplary embodiment prepared test samples as electrode chips having a different content of chromium (Cr) in the chromium rich layer in the electrode chip, and evaluated a wear resistance of each of the test samples.

The fourth exemplary embodiment prepared the electrode chips as the test samples having a base section and a chromium rich layer having a difference content (x3 mass %) of chromium (Cr). In the fourth exemplary embodiment, each of the electrode chips as test samples was comprised of a base section, a diffusion section and a chromium rich layer. The base section had a composition of 60W-30Cr-10 Pd. The chromium rich layer had a composition of (90−x3)W-x3Cr-10 Pd. The chromium rich layer had a thickness of 10 μm.

The fourth exemplary embodiment performed a durability test for spark plugs equipped with the electrode chips as the test samples in order to evaluate the wear resistance of each of the electrode chips as the test samples by the same method and procedures previously explained in the second exemplary embodiment.

Figure 7:
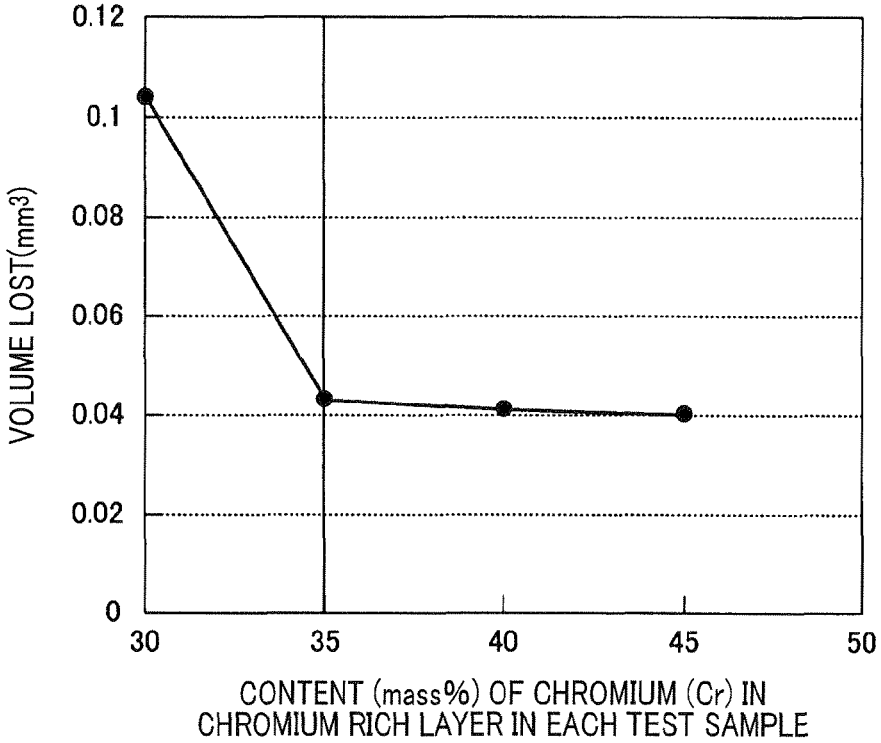
FIG. 7 is a view showing a graph of a relationship between a content (mass %) of chromium in a chromium rich layer and a volume lost of an electrode chip as test sample after a durability test according to the fourth exemplary embodiment.

FIG. 7 is a view showing a graph of a relationship between a content (mass %) of chromium (Cr) in the chromium rich layer and a lost volume ($mm^3$) of an electrode chip after a durability test according to the fourth exemplary embodiment.

As can be clearly understood from the test results shown in FIG. 7, the test samples having the chromium rich layer having a content of chromium (Cr) of not less than 35 mass % (which is larger in content of chromium contained in a base section by not less than 5%) had a lost volume of not more than 0.06 $mm^3$ after a durability test and as a result had a superior wear resistance. In particular, the test samples having the chromium rich layer having a content of chromium (Cr) of not less than 40 mass % (which is larger in content of chromium contained in a base section by not less than 10%) had a more decreased lost volume after a durability test and as a result had a more superior wear resistance.

On the other hand, the test samples having the chromium rich layer having a content of chromium of less than 35 mass % had an increased lost volume after a durability test.

It can be understood from the test results that in order to adequately maintain the wear resistance of the electrode chip in the spark plug, it is preferable for the chromium rich layer to contain chromium (Cr) which is larger in content than chromium (Cr) contained in the base section by not less than 5 mass %. Further, it is more preferable for the chromium rich layer to contain chromium (Cr) which is larger in content than chromium (Cr) contained in the base section by not less than 10 mass %.

Fifth Exemplary Embodiment

A description will be given of the fifth exemplary embodiment with reference to FIG. 8. The fifth exemplary embodiment prepared test samples as electrode chips having a different thickness of the chromium rich layer in the electrode chip, and evaluated a wear resistance of each of the test samples.

The fifth exemplary embodiment prepared the electrode chips. Each of the electrode chips as the test samples had the base section, the diffusion layer and the chromium rich layer. The base section had a composition of 60W-30Cr-10 Pd. The chromium rich layer had a composition of 52W-40Cr-8 Pd. The chromium rich layer in each of the electrode chips as the test samples had a different thickness.

The fifth exemplary embodiment performed a durability test for spark plugs equipped with the electrode chips as the test samples in order to evaluate the wear resistance of each of the electrode chips as the test samples by the same method and procedures previously explained in the second exemplary embodiment.

Figure 8:
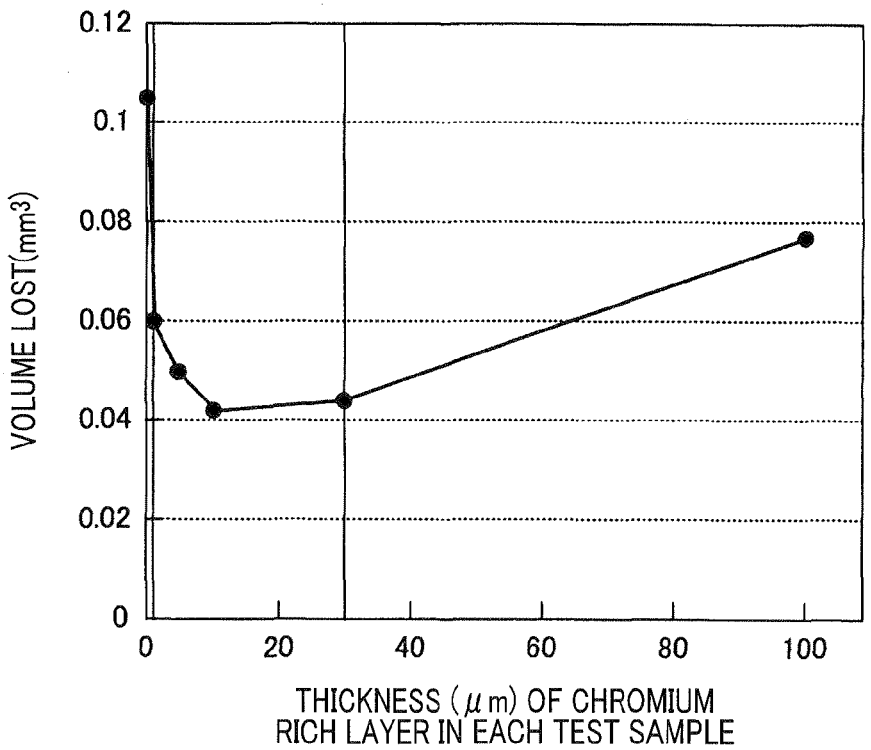
FIG. 8 is a view showing a graph of a relationship between a thickness of a chromium rich layer formed on a base section of each of electrode chips as test samples and a lost volume of the electrode chip after a durability test according to a fifth exemplary embodiment of the present invention.

FIG. 8 is a view showing a graph of a relationship between a thickness of the chromium rich layer and a lost volume of each of electrode chips as test samples after a durability test according to the fifth exemplary embodiment.

FIG. 8 shows the evaluation results of the durability test of the test sample. That is, FIG. 8 shows a relationship between a thickness (μm) of the chromium rich layer and a lost volume ($mm^3$) of each of the electrode chips after the durability test.

As can be clearly understood from the results shown in FIG. 8, the test samples having the chromium rich layer having a thickness within a range of 1 to 30 μm had a lost volume of not more than 0.06 $mm^3$ and as a result had a superior wear resistance. In particular, it can be understood that the test samples having the chromium rich layer having a thickness within a specific range of 5 to 30 μm had a more decreased lost volume and as a result had a more superior wear resistance.

On the other hand, the test samples having the chromium rich layer having a thickness within a range of less than 1 μm and more than 30 μm had an increased lost volume and as a result had a bad wear resistance.

As a result, it is preferable for the electrode chip to have a thickness of the chromium rich layer within a range of 1 to 30, and more preferable within a range of 5 to 30 μm in order to adequately maintain the wear resistance.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A spark plug for use in an internal combustion engine comprising:

a center electrode;

an earth electrode arranged to face the center electrode in order to form a spark discharge gap between the center electrode and the earth electrode; and an electrode chip formed on at least one of the center electrode and the earth electrode, wherein the electrode chip is comprised of: a base section; a chromium rich layer formed on at least a part of the base section; and a diffusion layer formed between the base section and the chromium rich layer, wherein the base section is comprised of: chromium within a range of 5 to 45 mass %; an element X within a range of 0.5 to 25 mass %; and a remainder composed of tungsten and unavoidable impurity, and content of chromium is larger in the chromium rich layer than that of the base section, and the element X contained in the base section is comprised of at least one of molybdenum, silicon, aluminum and palladium.

2. The spark plug for use in an internal combustion engine according to claim 1, wherein the chromium rich layer contains the same elements contained in the base section.

3. The spark plug for use in an internal combustion engine according to claim 1, wherein the chromium rich layer contains chromium which is larger in content than chromium contained in the base section by not less than 5 mass %.

4. The spark plug for use in an internal combustion engine according to claim 2, wherein the chromium rich layer contains chromium which is larger in content than chromium contained in the base section by not less than 5 mass %.

5. The spark plug for use in an internal combustion engine according to claim 1, wherein the chromium rich layer has a thickness within a range of 1 to 30 μm.

6. The spark plug for use in an internal combustion engine according to claim 2, wherein the chromium rich layer has a thickness within a range of 1 to 30 μm.

7. The spark plug for use in an internal combustion engine according to claim 1, wherein the electrode chip has the chromium rich layer processed by a diffusion metallizing process.

8. The spark plug for use in an internal combustion engine according to claim 2, wherein the electrode chip has the chromium rich layer processed by a diffusion metallizing process.

* * * * *